US011205437B1

(12) United States Patent
Zhang et al.

(10) Patent No.: US 11,205,437 B1
(45) Date of Patent: Dec. 21, 2021

(54) ACOUSTIC ECHO CANCELLATION CONTROL

(71) Applicant: Amazon Technologies, Inc., Seattle, WA (US)

(72) Inventors: Xianxian Zhang, Santa Clara, CA (US); Ramya Gopalan, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/216,741

(22) Filed: Dec. 11, 2018

(51) Int. Cl.

| | |
|---|---|
| ***G10L 21/0232*** | (2013.01) |
| ***H04R 1/40*** | (2006.01) |
| ***H04R 29/00*** | (2006.01) |
| ***G10L 25/21*** | (2013.01) |
| ***H04R 3/00*** | (2006.01) |
| *G10L 21/0208* | (2013.01) |

(52) U.S. Cl.
CPC ..... *G10L 21/0232* (2013.01); *G10L 25/21* (2013.01); *H04R 1/406* (2013.01); *H04R 3/005* (2013.01); *H04R 29/001* (2013.01); *G10L 2021/02082* (2013.01)

(58) Field of Classification Search
CPC ..... H04R 3/02; H04R 15/00; G10L 21/022; G10L 25/21; G10L 2021/02082; G10L 21/02; G10L 21/0232
USPC ..... 379/406.01–406.16
See application file for complete search history.

(56) References Cited

U.S. PATENT DOCUMENTS

| | | | | |
|---|---|---|---|---|
| 7,539,300 | B1 * | 5/2009 | Benyassine | H04B 3/234 379/406.04 |
| 8,498,407 | B2 * | 7/2013 | Mohammad | H04M 9/082 379/406.08 |
| 8,842,851 | B2 * | 9/2014 | Beaucoup | H04R 3/005 381/92 |
| 9,407,320 | B2 * | 8/2016 | Tan | H04M 9/085 |
| 9,747,920 | B2 * | 8/2017 | Ayrapetian | G10L 21/0216 |
| 9,818,425 | B1 * | 11/2017 | Ayrapetian | G10L 21/0224 |
| 10,122,863 | B2 * | 11/2018 | Zargar | H04B 3/21 |
| 2004/0131178 | A1 * | 7/2004 | Shahaf | H04M 9/08 379/406.01 |
| 2010/0135483 | A1 * | 6/2010 | Mohammad | H04M 9/082 379/406.08 |
| 2012/0163626 | A1 * | 6/2012 | Booij | G10K 11/17881 381/92 |
| 2013/0058464 | A1 * | 3/2013 | Tan | H04B 3/234 379/32.01 |
| 2014/0005738 | A1 * | 1/2014 | Jorgenson | A61N 1/3925 607/7 |
| 2014/0328490 | A1 * | 11/2014 | Mohammad | H04M 9/082 381/66 |
| 2019/0074025 | A1 * | 3/2019 | Lashkari | G10L 21/0232 |
| 2019/0104360 | A1 * | 4/2019 | Bou Daher | H04R 3/005 |
| 2019/0174218 | A1 * | 6/2019 | Kumar | G10K 11/178 |

* cited by examiner

*Primary Examiner* — Disler Paul
(74) *Attorney, Agent, or Firm* — Pierce Atwood LLP

(57) ABSTRACT

Techniques for improving acoustic echo cancellation are described. Energy levels of audio data received from a microphone and representing near-end audio and reference audio data representing far-end audio are determined. If near-end audio is detected but far-end audio is not detected, a controller turns of or bypasses an acoustic echo cancellation system until far-end audio is again detected, thereby decreasing or eliminating distortion of the near-end audio by the acoustic echo cancellation system.

20 Claims, 14 Drawing Sheets

ACOUSTIC ECHO CANCELLATION CONTROL

BACKGROUND

In audio systems, beamforming refers to techniques that are used to isolate audio from a particular direction. Beamforming may be particularly useful when filtering out noise from non-desired directions. Beamforming may be used for various tasks, including isolating voice commands to be executed by a speech-processing system.

BRIEF DESCRIPTION OF DRAWINGS

For a more complete understanding of the present disclosure, reference is now made to the following description taken in conjunction with the accompanying drawings.

DETAILED DESCRIPTION

Figure 1:
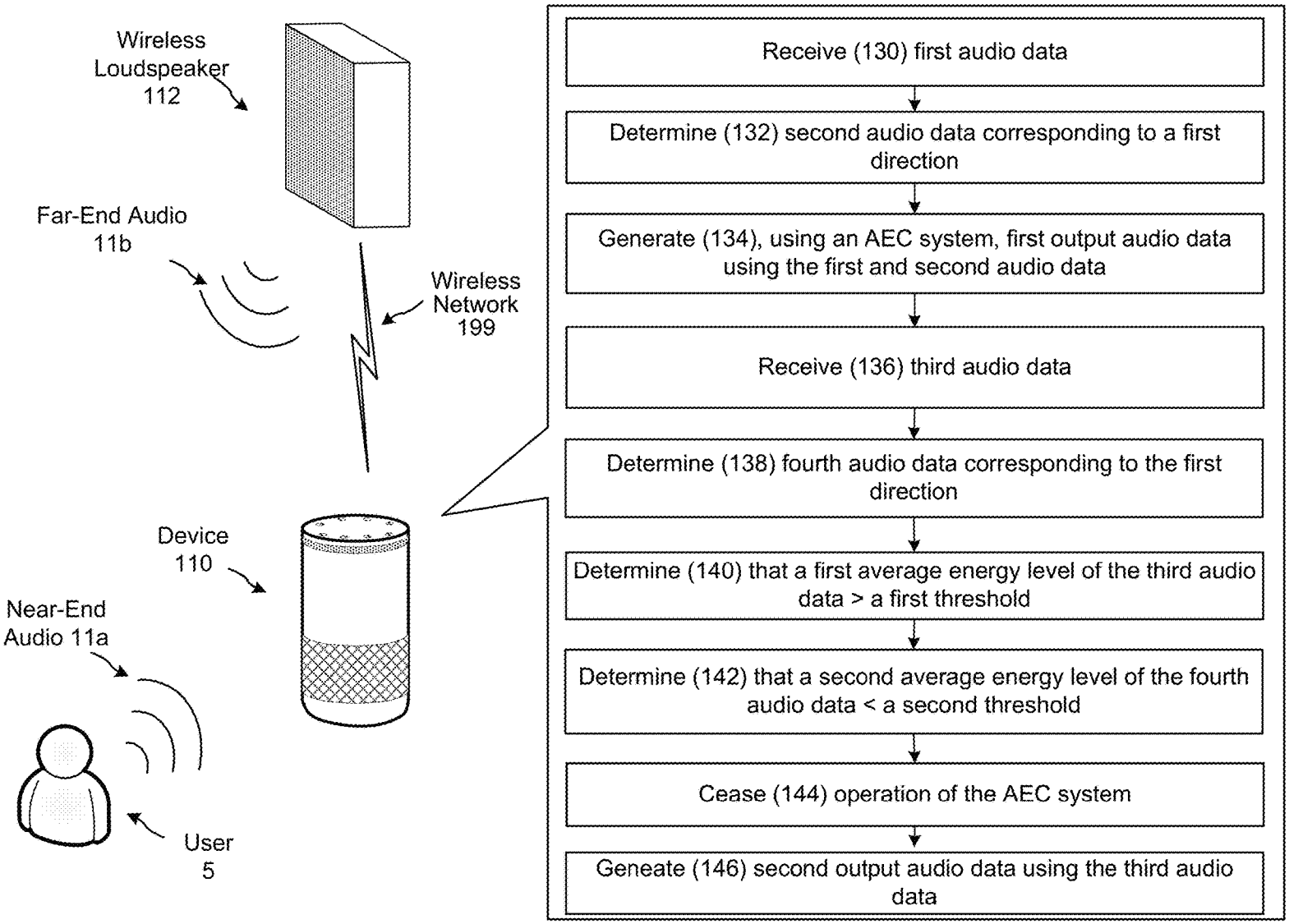
FIG. 1 illustrates a method for improving beam selection and reducing algorithm complexity according to embodiments of the present disclosure.

Certain audio devices capable of capturing speech for speech processing or voice communication may operate using a microphone array comprising multiple microphones, in which beamforming techniques may be used to isolate desired audio—including speech—from a particular direction. One technique for beamforming involves boosting audio received from a desired direction while dampening audio received from a non-desired direction. In one example of a beamformer system, a fixed beamformer (FBF) unit employs a filter-and-sum structure to boost an audio signal that originates from a desired direction (sometimes referred to as the look-direction) while largely attenuating audio signals that original from other directions. A fixed beamformer unit may effectively eliminate certain diffuse noise (e.g., undesireable audio), which is detectable in similar energies from various directions, but may be less effective in eliminating noise emanating from a single source in a particular non-desired direction. The beamformer unit may thus instead or in addition include an adaptive beamformer unit/noise canceller that may adaptively cancel noise from different directions depending on audio conditions.

Certain audio devices may be voice-controlled audio devices. Speech recognition systems have progressed to the point where humans can interact with computing devices using speech. Such systems employ techniques to identify the words spoken by a human user based on the various qualities of a received audio input. Speech recognition combined with natural language understanding processing techniques enable speech-based user control of a computing device to perform tasks based on the user's spoken commands. The combination of automatic speech recognition (ASR) and natural language understanding (NLU) processing techniques may be referred to as speech processing. Speech processing may also convert a user's speech into text data which may then be provided to various text-based software applications.

Acoustic echo cancellation (AEC) techniques may be used to avoid capturing, with the microphone array, audio output by the device itself and re-playing the captured audio over the loudspeaker. This "echo" may occur whenever the microphone array and loudspeaker are active at the same time and may repeat one or more times; the echo may fade after a certain number of repeats or may repeat indefinitely. To avoid this undesirable echo, the device may subtract the output audio from input audio signals received from the microphone array. This subtraction, however, requires that the output audio signal be well-defined in amplitude and time; if the output audio signal is shifted forward or back in time, its subtraction from the input signal will not be ideal, and the echo will be wholly or partially un-cancelled.

A reference signal for use with AEC may be generated based on playback audio data. Instead or in addition, adaptive reference algorithm (ARA) processing may generate an adaptive reference signal based on the input audio data. To illustrate an example, the ARA processing may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform adaptive interference cancellation (AIC) (e.g., adaptive acoustic interference cancellation) by removing the reference signal from the target signal. As the input audio data is not limited to the echo signal, the ARA processing may remove other acoustic noise represented in the input audio data in addition to removing the echo.

An audio device may include an adaptive beamformer and may be configured to perform AIC using the ARA processing to isolate speech in the input audio data. The adaptive beamformer may dynamically select target signal(s) and/or reference signal(s). Thus, the target signal(s) and/or the reference signal(s) may be continually changing over time based on speech, acoustic noise(s), ambient noise(s), and/or the like in an environment around the device. For example, the adaptive beamformer may select the target signal(s) by detecting speech, based on signal strength values or signal quality metrics (e.g., signal-to-noise ratio (SNR) values, average power values, etc.), and/or using other techniques or inputs, although the disclosure is not limited thereto. As an example of other techniques or inputs, the device may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the adaptive beamformer may identify the reference signal(s) based on the signal strength values and/or using other inputs without departing from the disclosure. Thus, the target signal(s) and/or the reference signal(s) selected by the adaptive beamformer may vary, resulting in different filter coefficient values over time.

In some scenarios, however, this type of AEC may undesirably cancel audio (such as speech) spoken or otherwise produced proximate to an audio device—this audio or speech is referred to herein as near-end audio or near-end speech. Audio spoken or otherwise produced at a location remote to the audio device and transmitted to the device for playback—which the AEC system is meant to cancel—is referred to herein as far-end audio or far-end speech. For example, if person A telephones person B using an audio device, the device of person A receives near-end speech from person A and outputs audio corresponding to far-end speech from person B. When near-end speech is being produced while no far-end speech is being output, the AEC distorts the near-end speech, causing recipients of the near-end speech (e.g., other users or speech processing systems) to receive speech that is garbled or otherwise difficult or impossible to understand or process. The distortion may be exacerbated when the far-end speech is sent via a local wireless network to an audio-output device, such as a wireless speaker, due to delays inherent in the local wireless network.

To improve AEC, systems and methods are disclosed herein that determine when near-end but not far-end audio is active and, when that condition is met, turn off or otherwise bypass an AEC system. The AEC system turns back on when far-end audio is active. Presence of the near-end and far-end audio may be determined by measuring an energy level of audio data received from a microphone (in the case of near-end audio) and an energy level of reference audio data (in the case of far-end speech). The measured energy levels may be compared to a threshold; the threshold may be determined by finding a minimum energy level present in the audio data over a period of time; this minimum energy level may be scaled by a scaling factor, such as 1.2. In some embodiments, FIG. 1 illustrates a system 100 that includes an audio device 110 that may include a microphone array, a built-in loudspeaker, and one or more network connections (such as a Wi-Fi and Bluetooth connections). The audio device 110 may be voice-controlled or may be controlled using other input, such as a keyboard, mouse, touchscreen, or buttons. The disclosure is not, however, limited to only these components, and the audio device 110 may include additional components without departing from the disclosure. The device 110 may be a computer, tablet computer, smartphone, in-home personal assistant, smart loudspeaker, or any other device. The audio device 110 is connected, using a wireless network 199, to a wireless loudspeaker 112. The wireless network 199 may be a Bluetooth network; the wireless loudspeaker 112 may be a stand-alone device or may be incorporated into another device, such as a wireless earbud or wireless earphone. The audio device 110 may output audio, such as voice, tones, music, or other audio; the audio device 110 may instead or in addition send audio data over the network 199 to the wireless loudspeaker 112, which may also or instead output the audio. The wireless loudspeaker 112 may be used with or instead of the audio device 110 to output audio because it may be capable of louder sound output or better sound quality or because the wireless loudspeaker 112 may be positioned closer to a user or listener. As mentioned above, the audio device 110 may receive near-end audio 11*a* from a user 5 and may receive far-end audio 11*b* from a remote device; the device 110 may transmit the far-end audio 11*b* to the wireless loudspeaker 112 for output thereon.

In various embodiments, the audio device receives, from a microphone array, (130) first audio data and determines (132) second audio data corresponding to a first direction. The audio device processes (134), using an AEC system, the first and second audio data to create first output audio data. For example, if the first direction corresponds to a user and near-end audio and the second direction corresponds to a wireless loudspeaker and far-end audio, echoes in the near-end audio caused by inclusion of the far-end audio therein, an AEC system may be used to remove the echoes from the near-end audio, as described in greater detail below, before the near end-audio is output (to, for example, a remote device). The audio device 110 receives (136) third audio data and determines (138) fourth audio data corresponding to the first direction. The audio device 110 determines (140) that a first average energy level of the third audio data is greater than a first threshold and determines (142) that a second average energy level of the fourth audio data is less than a second threshold (e.g., a near-end speaker is speaking and the wireless loudspeaker is not outputting far-end speech). The audio device 110 sends (144), to the AEC system, a command to stop processing and processes (146) the third audio data to create second output data.

As discussed above, the audio device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array 114 (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the audio device 110 may generate the beamformed audio data by boosting an audio signal originating from the desired direction (e.g., look direction) while attenuating audio signals that originate from other directions, although the disclosure is not limited thereto.

To perform the beamforming operation, the audio device 110 may apply directional calculations to the input audio signals. In some examples, the device 110 may perform the directional calculations by applying filters to the input audio signals using filter coefficients associated with specific directions. For example, the audio device 110 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 110. For example, the audio device 110 may store filter coefficients associated with hundreds of different directional calculations (e.g., hundreds of specific directions) and may select the desired filter coefficients for a particular beamforming operation at runtime (e.g., during the beamforming operation). To illustrate an example, at a first time the audio device 110 may perform a first beamforming operation to divide input audio data into 36 different portions, with each portion associated with a specific direction (e.g., 10 degrees out of 360 degrees) relative to the audio device 110. At a second time, however, the device 110 may perform a second beamforming operation to divide input audio data into 6 different portions, with each portion associated with a specific direction (e.g., 60 degrees out of 360 degrees) relative to the audio device 110.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the audio device 110 generates a plurality of "beams" (e.g., directional calculations and associated filter coefficients) and uses the "beams" to perform a beamforming operation and generate a plurality of beamformed audio signals. However, beams may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

In some examples, some or all of the above steps may be performed in the time domain. For example, the audio device 110 may apply filter coefficient values g(t) in the time domain to the input audio data to generate the beamforming data and may perform acoustic echo cancellation in the time domain. The present disclosure is not, however limited thereto. Instead or in addition, the audio device 110 may receive first input audio data in the time domain and may perform a transform, such as a Fast Fourier Transform (FFT), on the first input audio data to generate second input audio data in the frequency domain. The audio device 110 may then apply filter coefficient values g(w) in the frequency domain to the second input audio data to generate the LCB audio data and may perform acoustic echo cancellation in the frequency domain to generate first modified input audio data. The device 110 may perform an inverse transform, such as an Inverse Fast Fourier Transform (IFFT), on the first modified input audio data to generate second modified input audio data in the time domain. Thus, the audio device 110 perform beamforming and/or acoustic echo cancellation in the time domain and/or the frequency domain without departing from the disclosure. Additionally or alternatively, the audio device 110 may perform acoustic echo cancellation in a subband domain without departing from the disclosure. For example, the audio device 110 may separate different frequency ranges (e.g., subbands) and may perform acoustic echo cancellation differently for each frequency range without departing from the disclosure.

The audio device 110 may beamform the input audio data into a plurality of beams (e.g., perform a beamforming operation to generate beamformed audio data). As used herein, the term beam may refer to particular audio data corresponding to the modified input audio data that was captured by the microphone array, where the particular audio data of a beam corresponds to a particular direction. Thus, each beam may include audio data corresponding to a particular direction relative to the audio device 110. A beamforming unit or component of the audio device 110 (such as an adaptive beamformer) may divide the modified input audio data into different beams of audio data, each corresponding to a direction.

Figure 2:
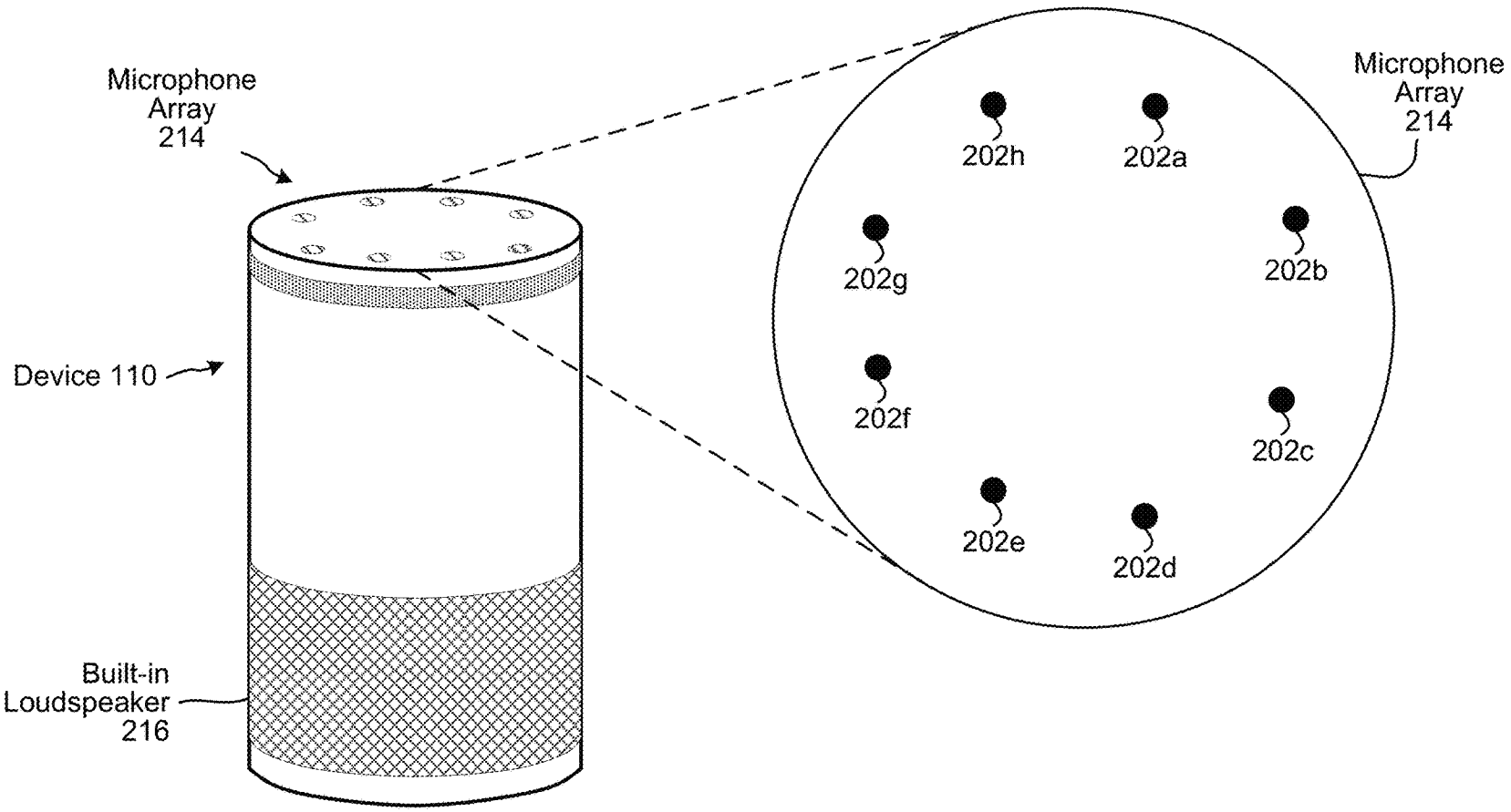
FIG. 2 illustrates a microphone array according to embodiments of the present disclosure.

As illustrated in FIG. 2, the audio device 110 may include, among other components, a microphone array 214, one or more built-in loudspeaker(s) 216, a beamformer unit (as discussed below), or other components. The microphone array 214 may include a number of different individual microphones. In the example configuration of FIG. 2, the microphone array 214 includes eight (8) microphones, 202*a*-202*h*. The individual microphones may capture sound and pass the resulting audio signal created by the sound to a downstream component, as discussed below. Each individual piece of audio data captured by a microphone may be in the time domain. To isolate audio from a particular direction, the device 110 may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the audio device 110 may determine that the source of the audio that resulted in the segment of audio data may be located closer to the first microphone than to the second microphone (which resulted in the audio being detected by the first microphone before being detected by the second microphone).

Figure 3A:
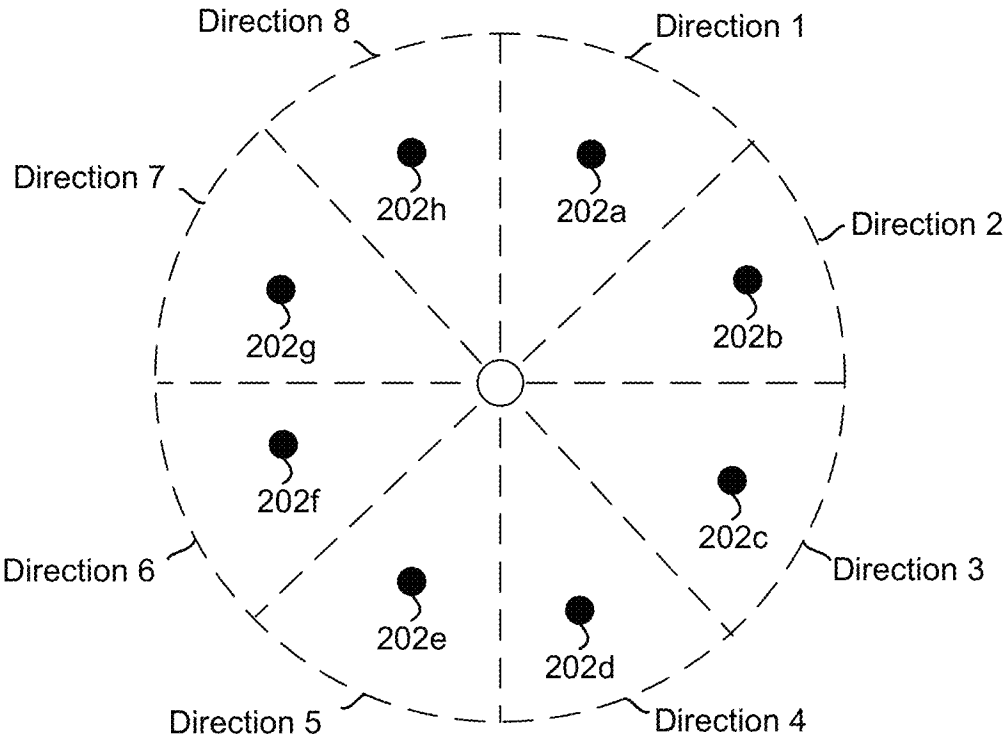
FIG. 3A illustrates associating directions with microphones of a microphone array according to embodiments of the present disclosure.

Using such direction isolation techniques, the audio device 110 may isolate directionality of audio sources. As shown in FIG. 3A, a particular direction may be associated with a particular microphone of a microphone array, where the azimuth angles for the plane of the microphone array may be divided into bins (e.g., 0-45 degrees and 46-90 degrees) where each bin direction is associated with a microphone in the microphone array. For example, direction 1 is associated with microphone 202*a*, direction 2 is associated with microphone 202*b*, and so on. Alternatively, particular directions and/or beams may not necessarily be associated with a specific microphone. Thus, the present disclosure is not limited to any particular number of microphones or directions, and the number of microphones and directions may differ.

To isolate audio from a particular direction the audio device 110 may apply a variety of audio filters to the output of the microphones where certain audio is boosted while other audio is dampened, to create isolated audio corresponding to a particular direction, which may be referred to as a beam. While the number of beams may correspond to the number of microphones, this need not be the case. For example, a two-microphone array may be processed to obtain more than two beams, thus using filters and beamforming techniques to isolate audio from more than two directions. Thus, the number of microphones may be more than, less than, or the same as the number of beams. The beamformer unit of the device may have an adaptive beamformer (ABF) unit/fixed beamformer (FBF) unit processing pipeline for each beam.

The audio device 110 may use various techniques to determine the beam corresponding to the look-direction. If audio is detected first by a particular microphone the audio device 110 may determine that the source of the audio is associated with the direction of the microphone in the array. Other techniques may include determining what microphone detected the audio with a largest amplitude (which in turn may result in a highest strength of the audio signal portion corresponding to the audio). Other techniques (either in the time domain or in the sub-band domain) may also be used such as calculating a signal-to-noise ratio (SNR) for each beam, performing voice activity detection (VAD) on each beam, or the like.

Figure 3B:
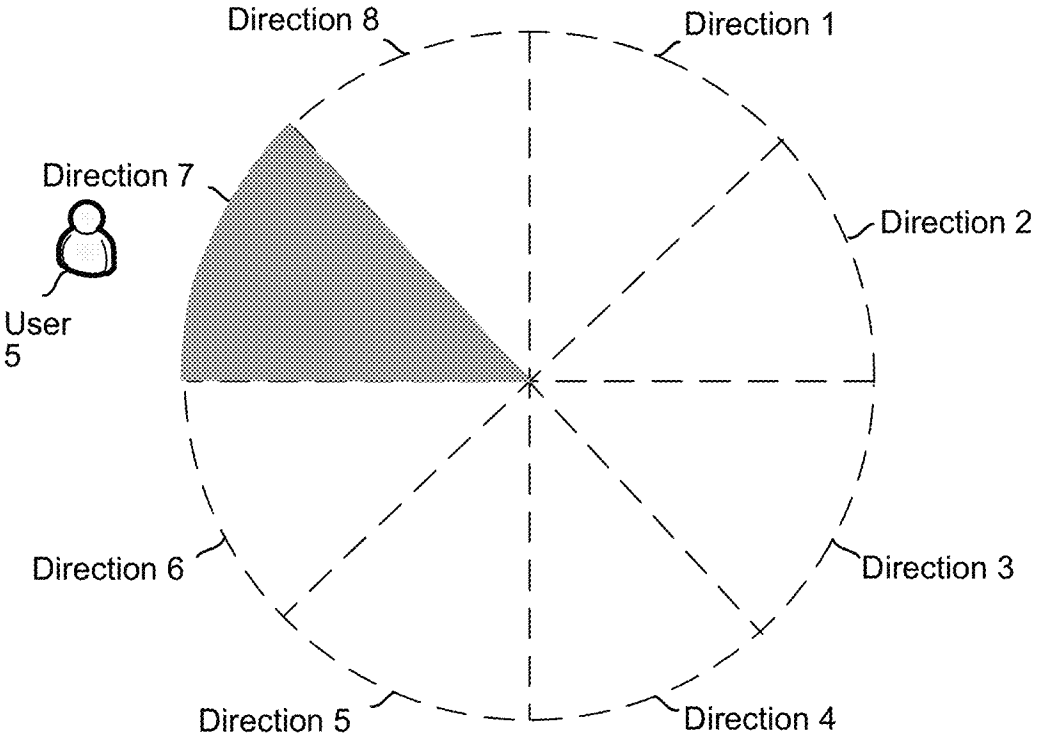
FIGS. 3B and 3C illustrate isolating audio from a direction to focus on a desired audio source according to embodiments of the present disclosure.
Figure 3C:
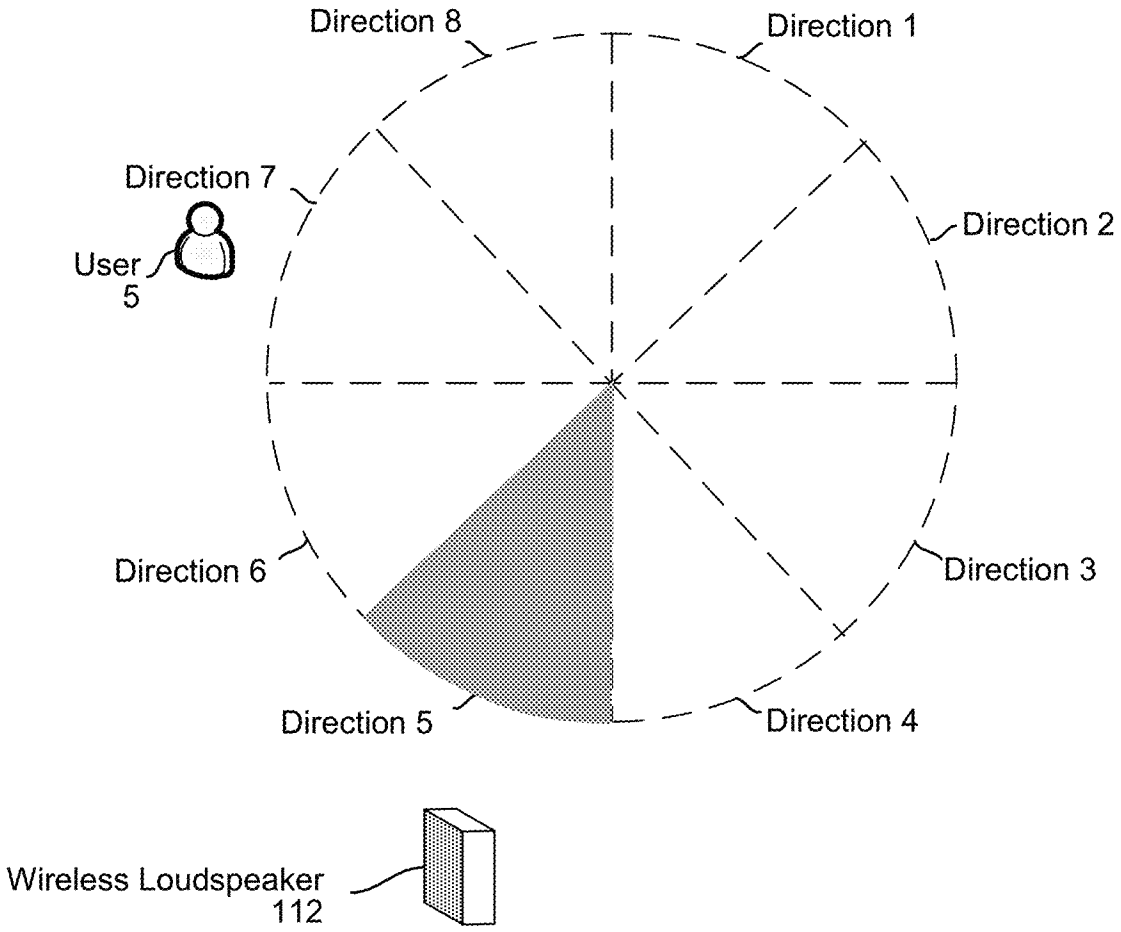

For example, if audio data corresponding to a user's speech is first detected and/or is most strongly detected by microphone 202*g*, the device may determine that the user is located in a location in direction 7. Using a FBF unit or other such component, the device may isolate audio coming from direction 7 using techniques known to the art and/or explained herein. Thus, as shown in FIG. 3B, the audio device 110 may boost audio coming from direction 7, thus increasing the amplitude of audio data corresponding to speech from user 5 relative to other audio captured from other directions. In this manner, noise from diffuse sources that is coming from all the other directions will be dampened relative to the desired audio (e.g., speech from user 5) coming from direction 7. In various embodiments, with reference to FIG. 3C, the audio device 110 may be disposed proximate the user 5 in a direction 7 and the wireless loudspeaker 112 in another direction 5.

Figure 4:
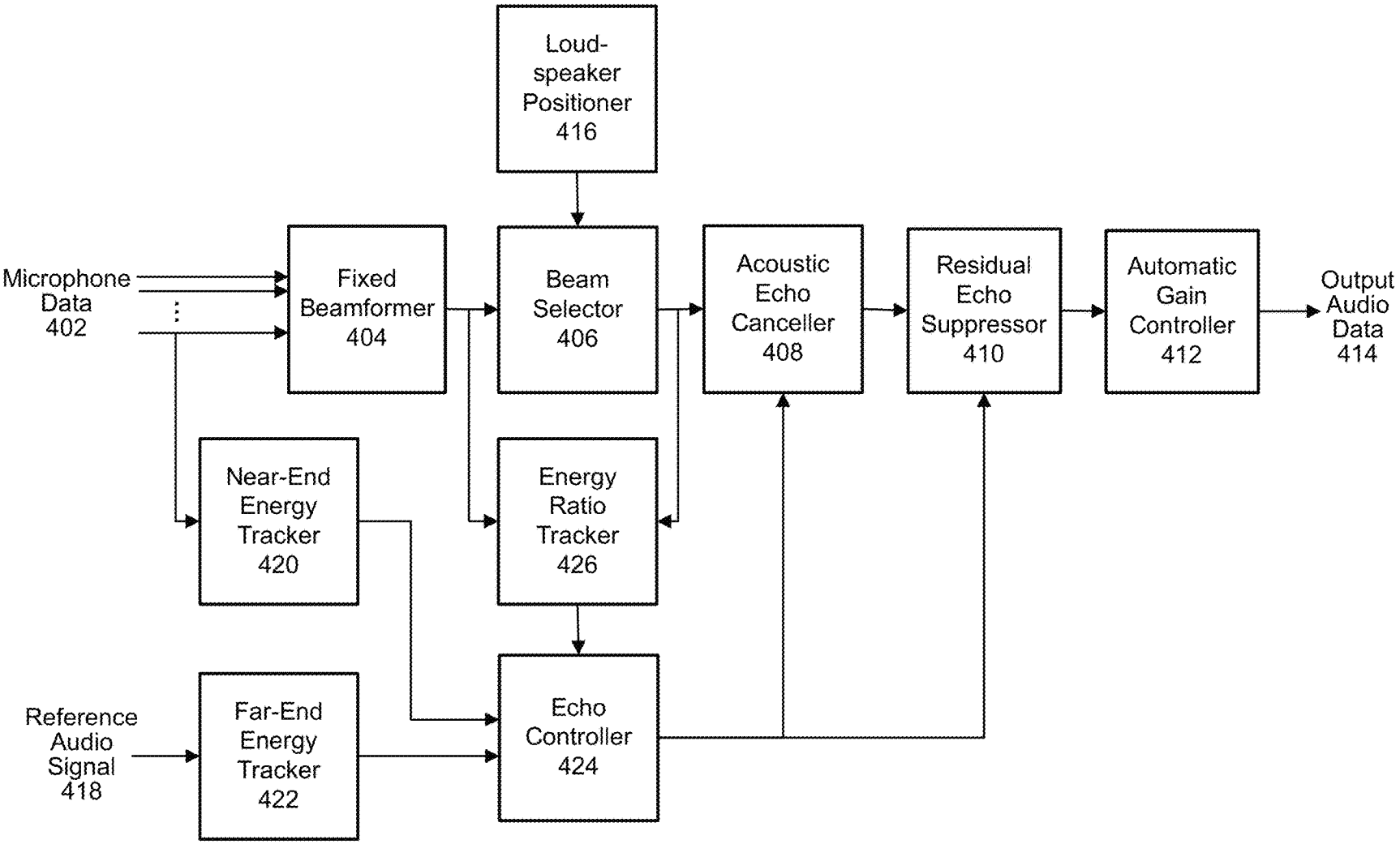
FIG. 4 illustrates a system for acoustic echo cancellation control according to embodiments of the present disclosure.

FIG. 4 illustrates a system for AEC control according to embodiments of the present disclosure. In various embodiments, two or more microphones 202 create audio data 402 corresponding to audio. The audio data 402 is received by a fixed beamformer 404 having one or more fixed beamforming units. The fixed beamformer 410 may isolate audio from a desired direction by boosting audio received from the desired direction while dampening audio received from a non-desired direction. For example, each of the FBF units 402 may include a filter-and-sum structure to boost an audio signal that originates from the desired direction (i.e., a "look" direction) while largely attenuating audio signals that originate from other directions.

A number of fixed beamformer units included in the fixed beamformer 4 may depend on a desired number of beams. For example, to generate twelve beams, the audio device 110 may include twelve separate fixed beamformer units, with each fixed beamformer unit processing the microphone outputs 402 to generate an individual beam (e.g., directional output, directional audio signal, beamformed audio data, or the like) corresponding to a particular direction. The fixed beamformer 402 may generate fixed beamformer outputs, which correspond to the desired number of beams. Thus, the microphone outputs 402 are separated into a plurality of audio signals, enabling the device 110 to process audio data associated with a particular direction.

The number of microphone outputs 402 and the number of fixed beamformer outputs may not be the same. The number of audio channels included in the microphone outputs 402 and/or the number of beams are typically factors of 2 (e.g., 2, 4, 6, 8, 12, etc.), although the disclosure is not limited thereto. For example, the microphone array 214 may include eight microphones whereas the device 110 may generate twelve beams. Additionally or alternatively, the number of audio channels included in the microphone outputs 402 and the number of beams may be the same without departing from the disclosure.

The fixed beamformer 404 may output the fixed beamformer outputs to a beam selector 406. The beam selector 406 may select one or more of the beamformer outputs as output beams. For example, the beam selector 406 may determine one or more signal quality metrics (e.g., loudness, SNR, power value, signal-to-noise plus interference ratio (SINR), and/or other signal quality metrics known to one of skill in the art) associated with each of the fixed beamformer outputs and may select the fixed beamformer output having the highest signal quality metric as the output beam(s).

The output beam(s) are input to acoustic echo cancellation (AEC) system 408. The AEC system 408 may perform AEC on the output beam(s). For example, a first AEC component may use a first output beam corresponding to a first direction as a target signal. The first AEC component may estimate a noise reference signal using the remaining audio signals (e.g., audio signals not associated with the first direction, such as a second output beam corresponding to a second direction) and may subtract the noise reference signal from the first output beam. Thus, the output of the first AEC component corresponds to audio data associated with the first direction after noise and/or interference is cancelled from the other directions.

A number of AEC components included in the AEC system 408 may depend on the desired number of beams and/or the number of output beam(s). For example, if there are two beams output by the beam selector 406, the audio device 110 may include two AEC systems 408 configured to perform adaptive noise cancellation and generate twelve AEC outputs. However, the disclosure is not limited thereto, and the number of AEC components included in the AEC system 408 may vary without departing from the disclosure.

The device 110 may further include a residual echo suppressor (RES) system 410 to remove (e.g., subtract or cancel) and/or attenuate any residual echo signal. In some examples the RES system 410 may determine an estimated echo signal based on playback audio data. For example, the device 110 may process the playback audio data and synchronize the playback audio data with the microphone data 402, apply adaptive filters to the playback audio data to generate the estimated echo signal and subtract the estimated echo signal from the microphone data 402. Thus, the RES 410 outputs correspond to the microphone data 402 after subtracting the estimated echo signal. An automatic gain controller (AGC) 412 may be used to automatically adjust the gain of the output audio data 414

A loudspeaker positioner 416 determines a location or position of the wireless loudspeaker 112. The loudspeaker positioner 416 may determine that a near-end speaker is not speaking during a time at which the wireless loudspeaker 112 is outputting far-end audio (as described herein). The loudspeaker positioner 416 may then determine which beam corresponds to a strongest or loudest audio signal and thereby determine that the chosen beam is the one in which the wireless loudspeaker 112 is disposed. This beam may thereafter be used, as described above, to generate a reference audio signal 418. The loudspeaker positioner 416 may periodically update the determined beam and corresponding position of the wireless loudspeaker 112 to compensate for motion of the audio device 110 and/or wireless loudspeaker 112.

A near-end energy tracker 420 receives microphone data 402 from one or more microphones 202 and determines whether near-end speech is present by analyzing an energy level of the microphone data 402. As explained in further detail below, the near-end energy tracker 420 may determine an average level of energy represented in the microphone data 402 over a period of time; the period of time may be, for example, 100 milliseconds, 500 milliseconds, 1 second, or 30 seconds. The near-end energy tracker 420 may instead or in addition determine the average energy level of the microphone data 402 by averaging the energy level of N samples of the microphone data 402. The near-end energy tracker 420 may output a signal corresponding to a yes/no decision; yes if the near-end speech is present and no if the near-end speech is not present. As also explained in greater detail below, the near-end energy tracker 420 may determine a minimum near-end energy over a period of time (e.g., 100 milliseconds, 500 milliseconds, 1 second, or 30 seconds) and may determine that the average energy is greater than or less than this minimum. In some embodiments, a scaling factor is first used to scale the minimum energy value before the comparison. A far-end energy tracker 422 receives a reference audio signal 418 and similarly determines whether far-end audio is present therein.

An echo controller 424 receives the outputs of the near-end energy tracker 420 and the far-end energy tracker 422 and, based thereon, turns off or otherwise bypasses the AEC system 408 when the near-end energy tracker 420 indicated near-end speech is present and the far-end energy tracker 422 indicates that far-end speech is not present. The AEC system 408 may thus be configured to stop cancelling echoes when based on a command from the echo controller 424; in other embodiments, the echo controller 424 activates a shunt or bypass around the AEC system 408. The echo controller 424 may send a second command to the AEC system 408 to continue cancelling echoes if and when far-end speech is detected, and may send further on/off commands to the AEC system 408 when near- or far-end speech is detected. The command may be a control signal that has a value indicating a command to turn off (e.g., zero or low) or a command to turn on (e.g., one or high). The echo controller 424 may similarly control the RES system 410 by sending a similar command.

An energy ratio tracker 426 may be used to track an energy ratio, such as a signal-to-interference ratio (SIR), between one or more beams output by the fixed beamformer 404 and the beam selected by the beam selector 406 (i.e., the "target" beam). The SIR may be used to determine whether audio received by the audio device 110 is near-end audio or far-end audio. If, for example, the SIR is greater than a threshold (e.g., 2), the energy ratio tracker 426 determines that the audio is near-end audio because the high SIR indicates that the audio is coming from the target beam. If, however, the SIR is less than the threshold, the energy ratio tracker 426 determines that the audio is far-end audio because the low SIR indicates that the audio is coming from a beam other than the target beam. If the energy ratio tracker 426 determines that the audio is far-end audio and if the echo controller 424 determines that the near-end energy tracker 420 indicates near-end audio, the echo controller 424 delays commanding the AEC system 408 to stop performing AEC. The energy ratio tracker 426 may re-compute the ratio, and the echo controller 424 may re-evaluate whether to turn off the AEC system 408, after a period of time (e.g., 1, 5, or 10 seconds) has elapsed.

The echo controller 424 may delay its turning off of the AEC system 408, as described above, during a time at which the device has finished sending audio data to the wireless loudspeaker 112 but the wireless loudspeaker 112 is still outputting audio corresponding to the audio data. Because some wireless protocols, like Bluetooth, may have variable transit times, the audio device 110 may not know the delay in time between ceasing sending audio data and ceasing output associated audio. During this time of uncertainty, the audio device 110 may not be otherwise able to distinguish between near- and far-end audio. The energy ratio tracker 426 may thus "listen" to a beam associated with the target (i.e., user) and rule out near-end speech if that beam has a low SIR.

The system of FIG. 4 may operate in the time domain (i.e., use time-domain signals) or in the frequency domain (i.e., use frequency-domain signals. A transform, such as a fast Fourier transform, may be used to convert the microphone data 402 to the frequency domain, and an inverse transform, such as an inverse fast Fourier transform, may be used to convert the output audio data 414 back to the time domain. The frequency domain signals may be split into different ranges or "bands" of frequencies, such as 20 Hz-5 kHz, 5 kHz-10 kHz, 10 kHz-15 kHz, and 15 kHz-20 kHz. One of skill in the art will understands that some or all of the components of FIG. 4 may be duplicated and used separately for each frequency band. The outputs of the different frequency bands may be re-combined to create a full-frequency-band signal before conversion back to the time domain.

Figure 5:
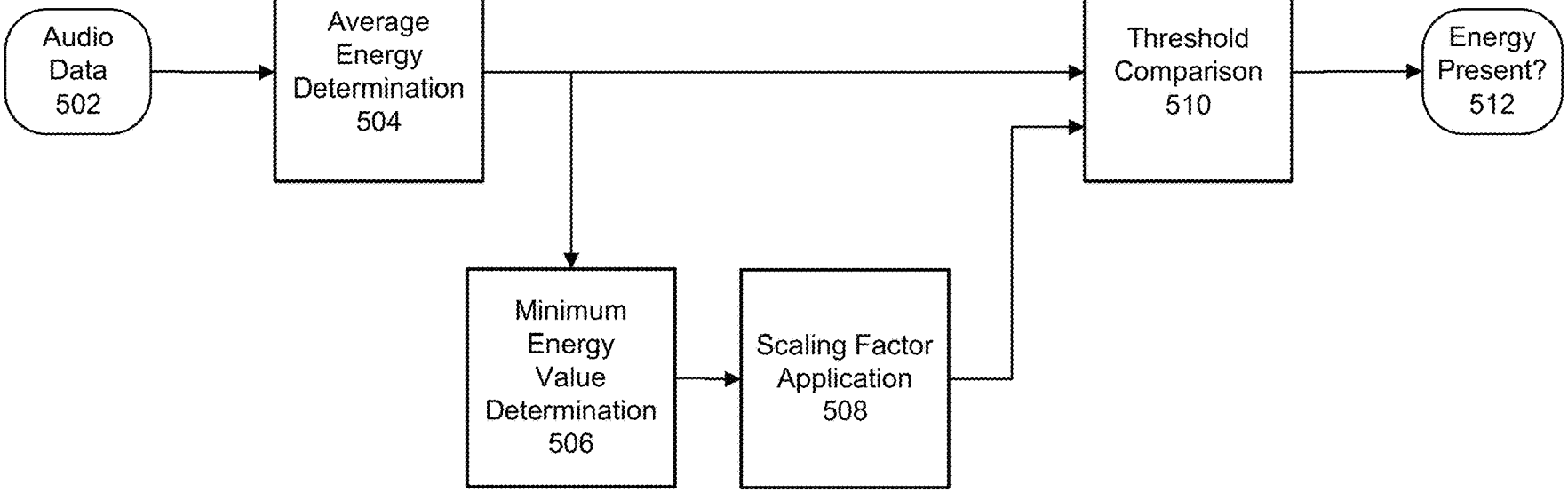
FIG. 5 illustrates a system for energy tracking according to embodiments of the present disclosure.

FIG. 5 illustrates an embodiment of the near-end energy tracker 420 and/or far-end energy tracker 422. Audio data 502, which may be the microphone data 402, is received by an average energy determination system 504. The audio data 502 may be received from a single microphone 202 or may be an average of audio data from two or more microphones 202. As described in greater detail below, the average energy determination system 504 may find an average of N samples of the audio data 502. In some embodiments, the average energy determination system 504 averages the sum of the squares of the N samples in accordance with equation (1).

$$AvgEg = \frac{1}{N}\sum_{n=1}^{N} x^2(n) \tag{1}$$

In this equation, N samples x(1), x(2), . . . x(N) are squared, summed and averaged. In another embodiment, the average energy determination system 504 averages the sum of the squares of the N samples in accordance with equation (2). N may be any value, such as 10, 100, or 1000.

$$AvgEg = \frac{1}{N-2M}\sum_{n=1+M}^{N-M} x^2 - x(n-M)*x(n+M) \tag{2}$$

In this equation, N samples x(1), x(2), . . . x(N) are squared but, before being summed, the square of a given sample is subtracted by the product of a first sample occurring before the given sample and a second sample occurring after the given sample. M may be any value, such as 1, 2, or 3. For example, if M is 1, a tenth sample x(10) is squared and the product of the ninth sample x(9) and the eleventh sample x(11) is subtracted from it. The method of computing the average of equation 2 thus measures a degree of change of the energy over time. For example, if the audio data 502 represents a loud, steady sound (i.e., the sound is not changing), the method of computing the average energy of equation (1) will produce a large value, while the method of computing the average energy of equation (2) will produce a low or zero value. The method of computing the average energy of equation (2) thus reduces or eliminates the effect that steady background noise may have on the average energy computation. Equation (2) may be referred to as a Teager energy operator (TEO).

A minimum energy value determination system 506 may determine a minimum energy value of the audio data 502. The minimum energy value determination system 406 may monitor the output of the average energy determination system 504 over a period of time or samples, such as 10, 100, or 1000 samples and store a minimum observed energy value. If a lower energy value is observed than the stored value, the minimum energy value determination system 406 stores the lower value. If the stored value is stored for a maximum amount of time, such as 10, 100, or 1000 samples, the minimum energy value determination system 406 may store the lowest value present in the period of time.

A scaling factor application system 508 may apply a scaling factor to the minimum energy value determined by the minimum energy value determination system 406. The scaling factor may be, for example, 1.2, 1.5, or 2. The scaling factor application system 508 may include a multiplier that multiplies the minimum energy value by the scaling factor and outputs the result. The scaling factor may allow the near-end energy tracker 420 and/or far-end energy tracker 422 to determine that energy is present in their respective input signals only when the average energy is sufficiently above the minimum energy.

A threshold comparison system 510 may compare the average energy determined by the average energy determination system 504 to the scaled minimum energy determined by the scaling factor application system 508. If the average energy is greater than the scaled minimum energy, the threshold comparison system 510 determines that energy is present in the audio data 502; if lower, the threshold comparison system 510 determines that energy is not present. The output 512 of the threshold comparison system 510 may be a control signal with values, such as 1 and 0, assigned to the presence/absence of the energy.

Figure 6A:
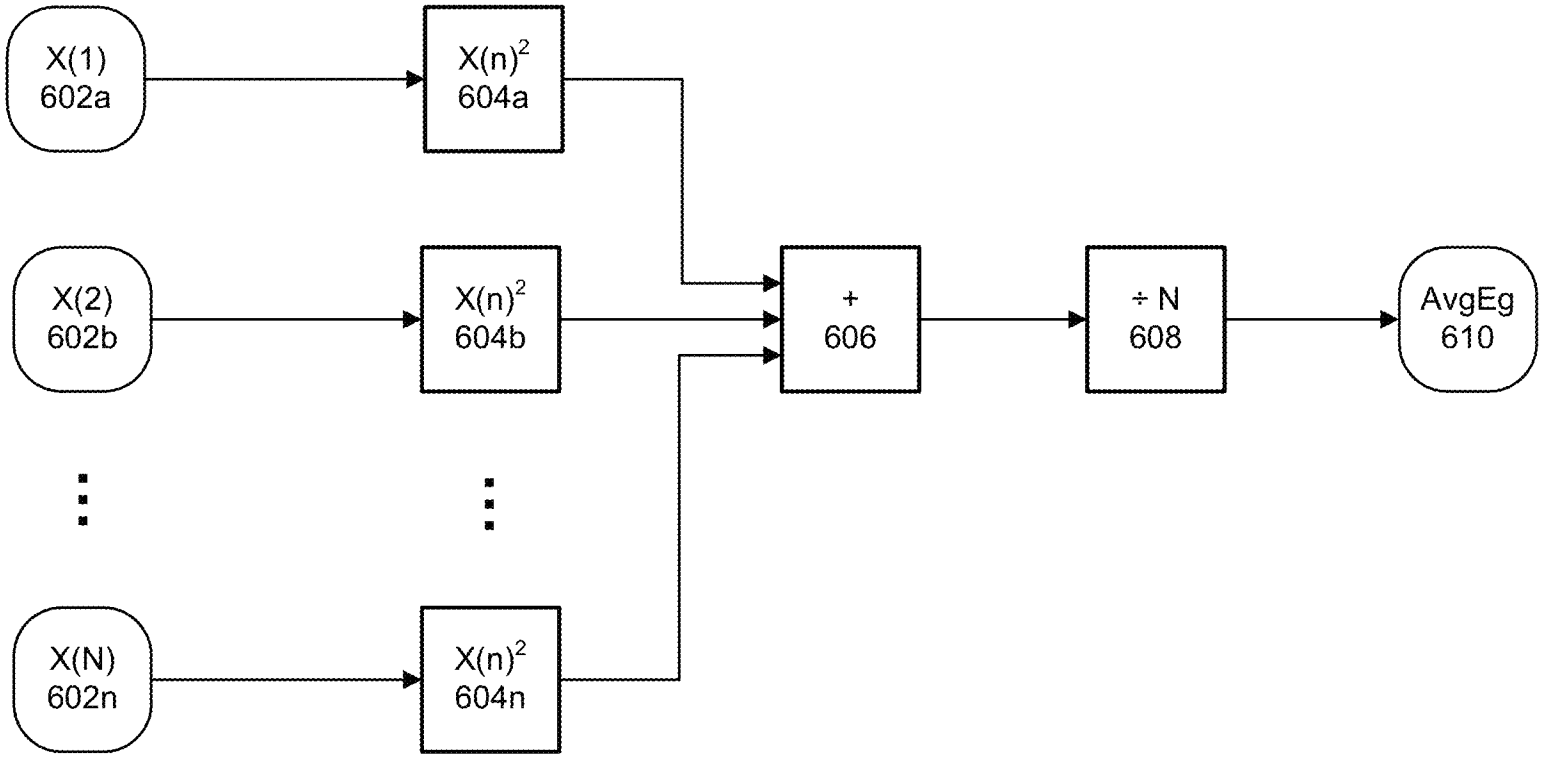
FIGS. 6A and 6B illustrate systems for measuring average energy levels according to embodiments of the present disclosure.
Figure 6B:
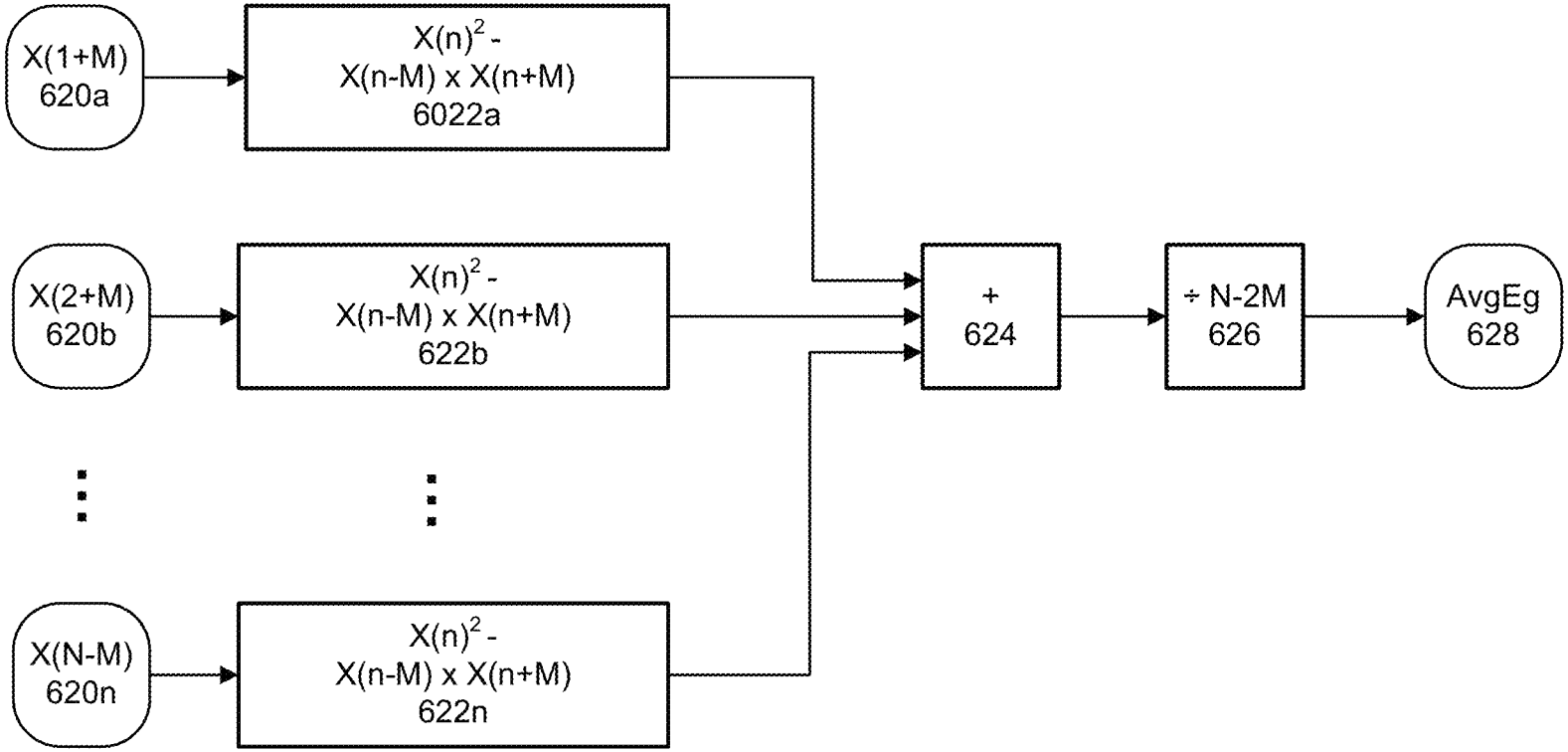

FIGS. 6A and 6B illustrate implementations of the average energy determination system 504. Referring first to FIG. 6A and equation (1), an N number of samples X(n) 602 are squared by squaring components 604. The outputs of the squaring units 604 are summed by a summation component 606 and averaged over the N samples by an averaging component 608 to create the average energy 610. Referring to FIG. 6B and equation (2), an (N−M) number of samples X(n) 620 are squared by squaring components 622; the product of an (N−M) sample and an (N+M) sample are subtracted thereform. The outputs of the squaring units 622 are summed by a summation component 624 and averaged over the N-2M samples by an averaging component 626 to create the average energy 628. The components of FIGS. 6A and 6B may be implemented using discrete components or systems, such as adders, multipliers, subtracters, and averagers. In other embodiments, the components of FIGS. 6A and 6B are implemented using a filter, such as a finite impulse response (FIR) filter or infinite impulse response (IIR) filter.

Figure 7:
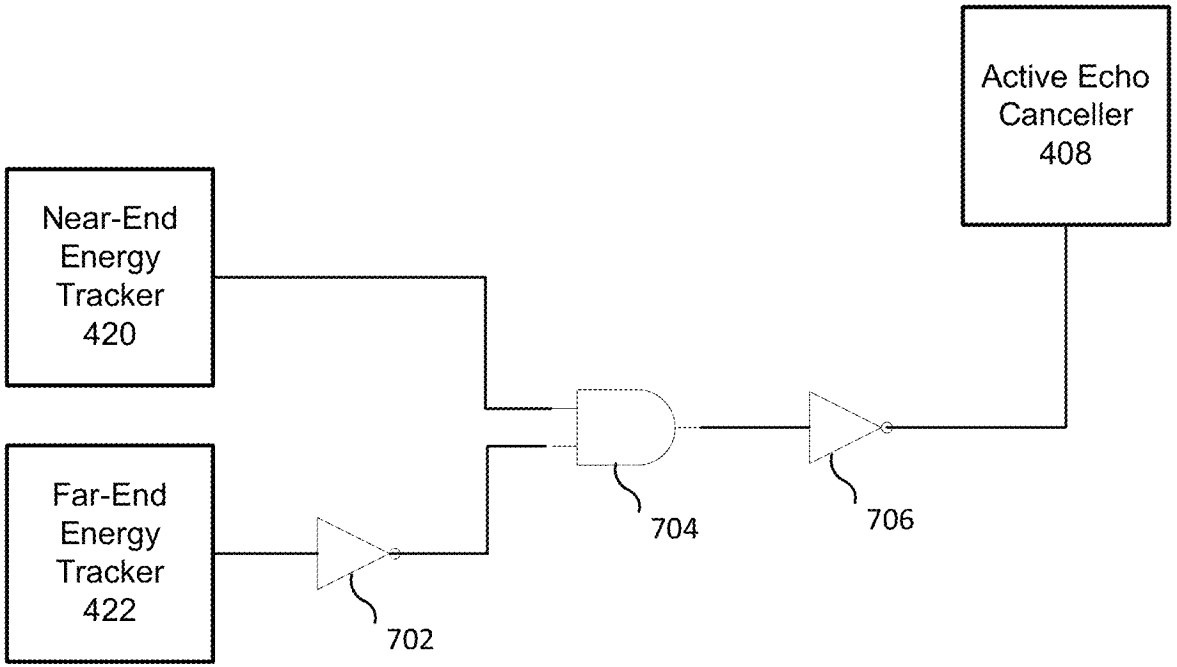
FIG. 7 illustrates a system for acoustic echo cancellation control according to embodiments of the present disclosure.

FIG. 7 illustrates one embodiment of the echo controller 424. In this embodiment, the AEC system 408 is active when it receives a high or 1 control input and inactive when it receives a low or 0 control input, but one of skill in the art will understand that other control inputs are within the scope of the present disclosure. The output of the far-end energy tracker 422 is inverted using an inverter 702, and the result is anded using an and gate 504. The output of the and gate 404 is inverted using a second inverter 706, the output of which is received by the AEC system 408.

Figure 8A:
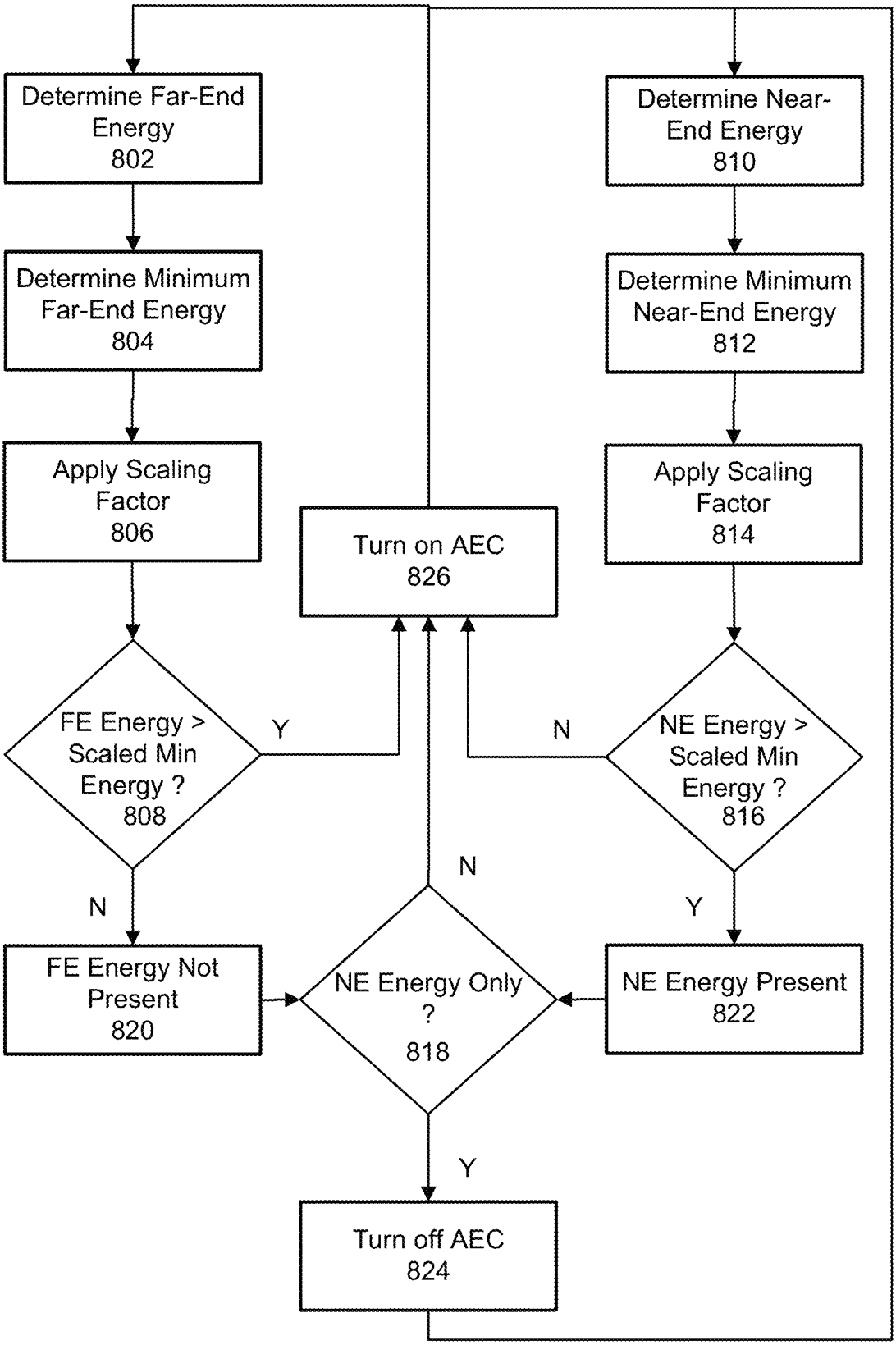
FIGS. 8A and 8B are flow diagrams for acoustic echo cancellation control according to embodiments of the present disclosure.

FIGS. 8A and 8A are flow diagrams for acoustic echo cancellation control according to embodiments of the present disclosure. Referring first to FIG. 8A, the far-end energy tracker 422 determines (802) the far-end energy, and the minimum energy value determination system 406 determines (804) the minimum far-end energy. The scaling factor application system 508 applies (806) the scaling factor thereto. The threshold comparison system 510 determines (808) if energy is present in the far-end signal. Similarly, the near-end energy tracker 420 determines (810) the near-end energy, and the minimum energy value determination system 406 determines (812) the minimum near-end energy. The scaling factor application system 508 applies (814) the scaling factor thereto. The threshold comparison system 510 determines (816) if energy is present in the near-end signal. The echo controller 424 then determines (818) if only near-end energy is present by determining (820) far-end energy is not present and determining (822) that near-end energy is present. If so, the echo controller 424 turns off (824) the AEC system 408; if not, the echo controller 424 turns on (826) the AEC system 408.

Figure 8B:
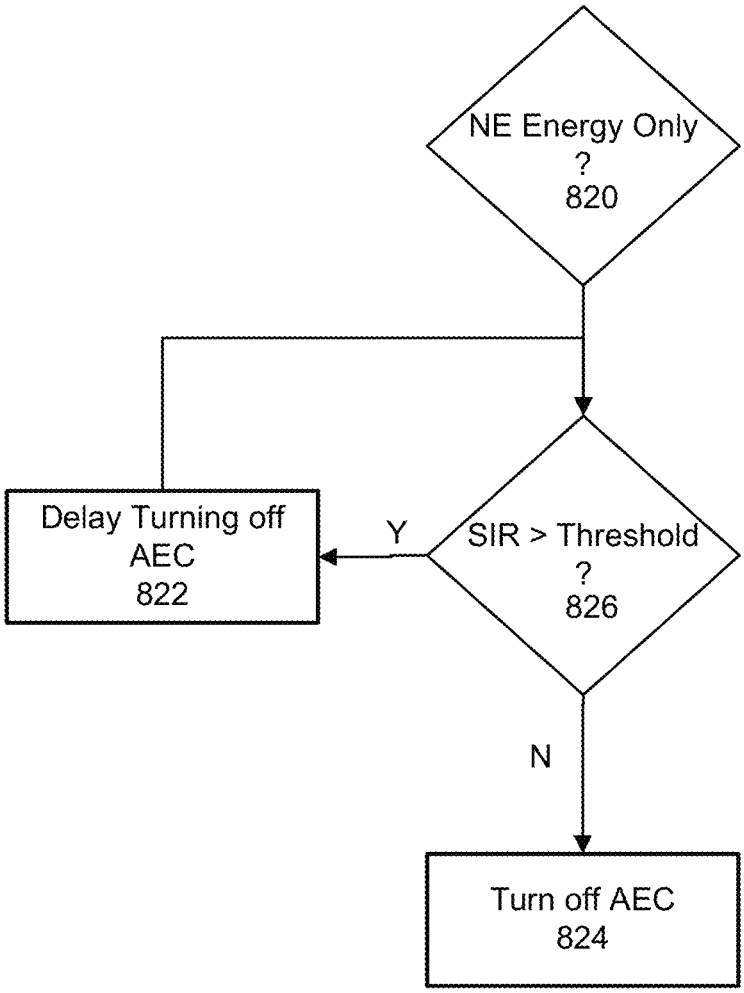

Referring to FIG. 8B, after determining (820) that only near-end energy is present, the echo controller 424 may delay (822) turning off (824) the AEC system 408. The energy ratio tracker 426 may compute an energy ratio, such as an SIR, between a selected beam and other beams. The echo controller 424 may receive this determined ratio and compare (826) it to a threshold, such as 1.5; if the energy ratio is greater than the threshold, the echo controller 424 delays turning off the AEC system 408 until the energy ratio falls below the threshold.

Figure 9:
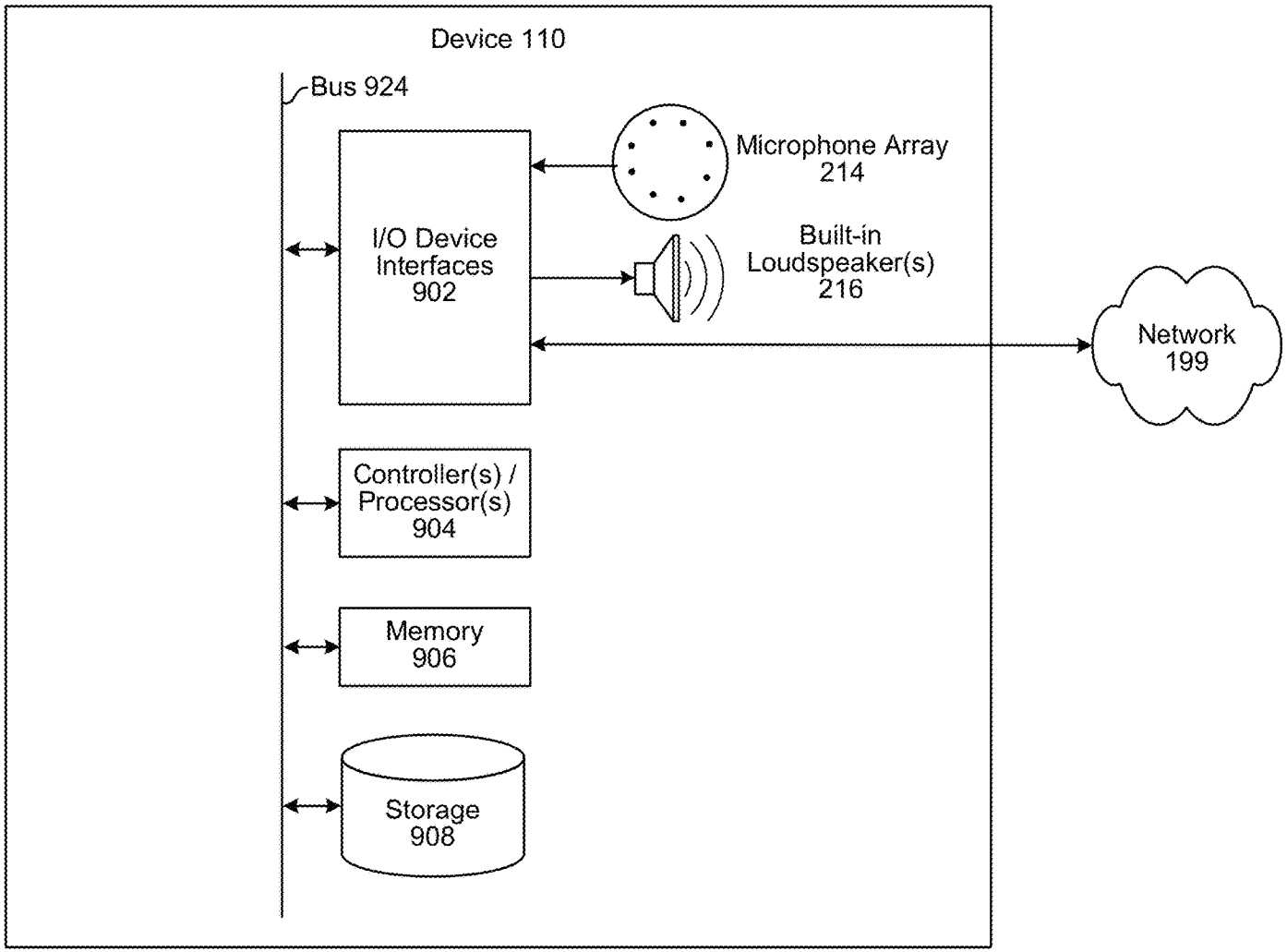
FIG. 9 illustrates a system for acoustic echo cancellation control according to embodiments of the present disclosure.

FIG. 9 is a block diagram conceptually illustrating example components of the device 110. In operation, the device 110 may include computer-readable and computer-executable instructions that reside on the device, as will be discussed further below.

The audio device 110 may include one or more audio capture device(s), such as a microphone array 114 which may include a plurality of microphones 202. The audio capture device(s) may be integrated into a single device or may be separate. The audio device 110 may also include an audio output device for producing sound, such as built-in loudspeaker(s) 116. The audio output device may be integrated into a single device or may be separate. The audio device 110 may include an address/data bus 924 for conveying data among components of the audio device 110. Each component within the device may also be directly connected to other components in addition to (or instead of) being connected to other components across the bus 924.

The audio device 110 may include one or more controllers/processors 904, which may each include a central processing unit (CPU) for processing data and computer-readable instructions, and a memory 906 for storing data and instructions. The memory 906 may include volatile random access memory (RAM), non-volatile read only memory (ROM), non-volatile magnetoresistive (MRAM) and/or other types of memory. The device 110 may also include a data storage component 908, for storing data and controller/processor-executable instructions (e.g., instructions to perform operations discussed herein). The data storage component 908 may include one or more non-volatile storage types such as magnetic storage, optical storage, solid-state storage, etc. The audio device 110 may also be connected to removable or external non-volatile memory and/or storage (such as a removable memory card, memory key drive, networked storage, etc.) through the input/output device interfaces 902.

Computer instructions for operating the audio device 110 and its various components may be executed by the controller(s)/processor(s) 904, using the memory 906 as temporary "working" storage at runtime. The computer instructions may be stored in a non-transitory manner in non-volatile memory 906, storage 908, or an external device. Alternatively, some or all of the executable instructions may be embedded in hardware or firmware in addition to or instead of software.

The audio device 110 may include input/output device interfaces 902. A variety of components may be connected through the input/output device interfaces 902, such as the microphone array 114, the loudspeaker(s) 116, and a media source such as a digital media player (not illustrated). The input/output interfaces 902 may include A/D converters (not illustrated) and/or D/A converters (not illustrated).

The input/output device interfaces 902 may also include an interface for an external peripheral device connection such as universal serial bus (USB), FireWire, Thunderbolt or other connection protocol. The input/output device interfaces 902 may also include a connection to one or more networks 199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 999, the device 110 may be distributed across a networked environment.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

Figure 10:
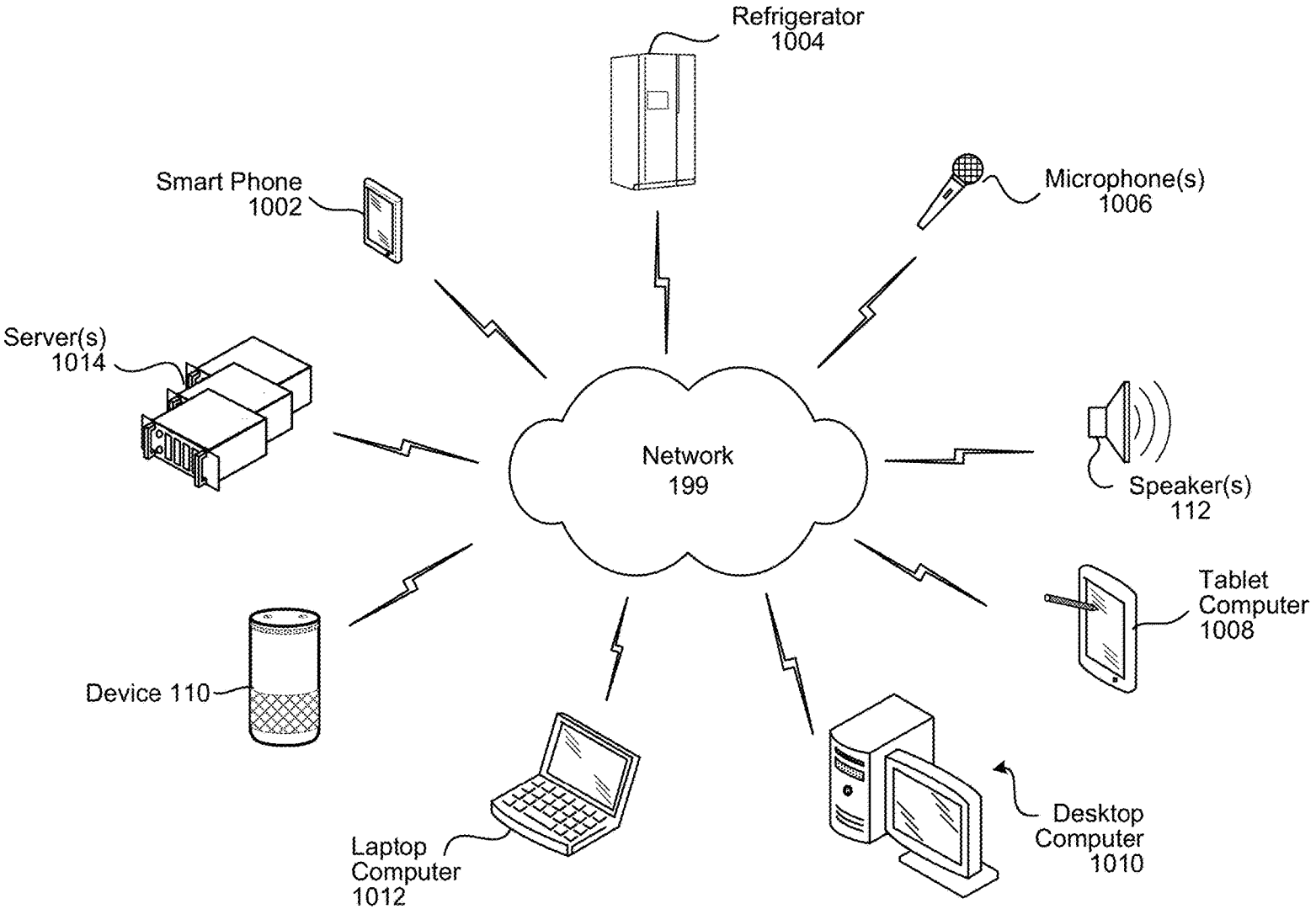
FIG. 10 illustrates a network including a system for acoustic echo cancellation control according to embodiments of the present disclosure.

As illustrated in FIG. 10, the audio device 110 may be connected over the network(s) 199. The network(s) 199 may include a local or private network or may include a wide network such as the Internet. Devices may be connected to the network(s) 199 through either wired or wireless connections. For example, the audio device 110*a*, a smart phone 1002, a smart refrigerator 1004, a wireless microphone 1006, a tablet computer 1008, a desktop computer 1010, and/or a laptop computer 1012 may be connected to the network(s) 199 through a wireless service provider, over a WiFi or cellular network connection, or the like. Other devices are included as network-connected support devices, such as a server 1014. The support devices may connect to the network(s) 199 through a wired connection or wireless connection.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the audio device 110 may be implemented by a digital signal processor (DSP).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving, at an audio device via a Wi-Fi network, first audio data;

sending, by the audio device to a wireless loudspeaker via a Bluetooth network, the first audio data;

receiving, by the audio device, second audio data including a first representation of the first audio data;

receiving, from a microphone of the audio device, third audio data;

determining, by the audio device, a first minimum energy value represented in the second audio data during a first time range;

determining, by the audio device, a second minimum energy value represented in the third audio data during the first time range;

determining, by the audio device, a first average energy value of the second audio data during a second time range after the first time range;

determining, by the audio device, a second average energy value of the third audio data during the second time range;

determining, by the audio device, that the first average energy value is less than the first minimum energy value;

determining, by the audio device, that the second average energy value is greater than the second minimum energy value; and based at least in part on determining that the first average energy value is less than the first minimum energy value and that determining that the second average energy value is greater than the second minimum energy value, turning off, by the audio device, an acoustic echo cancellation (AEC) component of the audio device.

2. The computer-implemented method of claim 1, further comprising:

receiving, by the audio device, fourth audio data including a second representation of the first audio data;

determining, by the audio device, a third average energy value of the fourth audio data during a third time range after the second time range;

determining, by the audio device, a fourth average energy value of fifth audio data during the third time range;

determining, by the audio device, that the third average energy value is greater than the first minimum energy value;

determining, by the audio device, that the fourth average energy value is less than the second minimum energy value; and based at least in part on determining that the third average energy value is greater than the first minimum energy value and that determining that the fourth average energy value is less than the second minimum energy value, turning on, by the audio device, the AEC component.

3. The computer-implemented method of claim 1, further comprising:

receiving, by the audio device, fourth audio data including a second representation of the first audio data;

determining, by the audio device, a third average energy value of the fourth audio data during a third time range after the second time range;

determining, by the audio device, that the third average energy value is greater than the first minimum energy value;

determining, by the audio device, that a signal-to-interference ratio of the fourth audio data is less than a threshold; and based at least in part on determining that the signal-to-interference ratio is less than a threshold, turning on, by the audio device, the AEC component.

4. The computer-implemented method of claim 1, wherein determining the first average energy value comprises:

determining, by the audio device, a first sample of the second audio data, the first sample corresponding to a first time;

determining, by the audio device, a second sample of the second audio data, the second sample corresponding to a second time after the first time;

determining, by the audio device, a third sample of the second audio data, the third sample corresponding to a third time after the second time; and subtracting, by the audio device, a product of the first sample and the second sample from a square of the second sample.

5. A computer-implemented method, the method comprising:

receiving, by a device, first audio data;

determining, by the device, second audio data corresponding to a first direction relative to the device;

determining that a first average energy level of the first audio data is greater than a first threshold;

determining that a second average energy level of the second audio data is lower than a second threshold;

based at least in part on determining that the first average energy level of the first audio data is greater than the first threshold and the second average energy level of the second audio data is lower than the second threshold, ceasing, by the device, operation of an acoustic echo cancellation (AEC) component of the device; and generating first output data using the first audio data.

6. The computer-implemented method of claim 5, further comprising:

receiving, by the device, third audio data;

determining, by the device, fourth audio data corresponding to the first direction;

determining that a third average energy level of the fourth audio data is greater than the first threshold;

starting, by the device, operation of the AEC component; and generating second output audio data using the third audio data and the fourth audio data.

7. The computer-implemented method of claim 6, wherein prior to starting operation of the AEC component, the method further comprises:

determining that a fourth average energy level of the third audio data is greater than the first threshold.

8. The computer-implemented method of claim 5, wherein:

determining that the first average energy level is greater than the first threshold is based at least in part on determining a first difference between a first amplitude of a first sample of the first audio data and a second amplitude of a second sample of the first audio data; and determining that the second average energy level is lower than the second threshold is based at least in part on determining a second difference between a third amplitude of a third sample of the second audio data and a fourth amplitude of a fourth sample of the second audio data.

9. The computer-implemented method of claim 8, further comprising:

subtracting, by the device, a first product of the first sample and the second sample from a square of the second sample; and subtracting, by the device, a second product of the third sample and the fourth sample from a square of the fourth sample.

10. The computer-implemented method of claim 5, further comprising:

determining a first minimum energy value represented in the first audio data;

determining a second minimum energy value represented in the second audio data;

determining the first threshold by multiplying the first minimum energy value by a hysteresis scaling factor; and determining the second threshold by multiplying the second minimum energy value by the hysteresis scaling factor.

11. The computer-implemented method of claim 5, further comprising:

sending, to a wireless audio-output device, third audio data, wherein the third audio data includes a representation of the third audio data;

determining fourth audio data corresponding to a second direction; and determining that a signal-to-interference ratio of the fourth audio data is less than a threshold.

12. The computer-implemented method of claim 5, further comprising:

receiving, from the device, third audio data;

determining, using the device, fourth audio data corresponding to the first direction;

determining that a third average energy level of the third audio data is less than the first threshold;

determining that a fourth average energy level of the fourth audio data is greater than the first threshold; and associating the first direction with an audio-output device.

13. A computing system comprising:

at least one processor; and at least one memory including instructions that, when executed by the at least one processor, cause the computing system to:

receive, from a device, first audio data;

determine, by the device, second audio data corresponding to a first direction relative to the device;

determine that a first average energy level of the first audio data is greater than a first threshold, the first average energy level based at least in part on a first degree of change of the first audio data, the first degree of change based at least in part on subtracting a first product from a first square of a first sample of the first audio data;

determine that a second average energy level of the second audio data is lower than a second threshold, the second average energy level based at least in part on a second degree of change of the second audio data, the second degree of change based at least in part on subtracting a second product from a second square of a second sample of the second audio data;

ceasing, by the device, operation of an acoustic echo cancellation (AEC) component; and generate first output data using the first audio data.

14. The computing system of claim 13, wherein the at least one memory further includes instructions that, when executed by the at least one processor, further cause the computing system to:

receiving, from the device, third audio data;

determine, by the device, fourth audio data corresponding to the first direction;

determine that a third average energy level of the fourth audio data is greater than the first threshold;

based at least in part on determining that the third average energy level is greater than the second threshold, starting, by the device, operation of the AEC component; and generate second output audio data using third audio data and the fourth audio data.

15. The computing system of claim 14, wherein the at least one memory further includes instructions that, when executed by the at least one processor, further cause the computing system to:

determine that a fourth average energy level of the third audio data is greater than the first threshold.

16. The computing system of claim 13, wherein the at least one memory further includes instructions that, when executed by the at least one processor, further cause the computing system to:

determine that the first average energy level is greater than the first threshold is based at least in part on determining a first difference between a first amplitude of the first sample of the first audio data and a second amplitude of a third sample of the first audio data; and determine that the second average energy level is lower than the second threshold is based at least in part on determining a second difference between a third amplitude of a fourth sample of the second audio data and a fifth amplitude of a fourth sample of the second audio data.

17. The computing system of claim 13, wherein the at least one memory further includes instructions that, when executed by the at least one processor, further cause the computing system to:

determine a first minimum value;

determine a second minimum value, determine the first threshold by multiplying the first minimum value by a hysteresis scaling factor; and determine the second threshold by multiplying the second minimum value by the hysteresis scaling factor.

18. The computing system of claim 13, wherein the at least one memory further includes instructions that, when executed by the at least one processor, further cause the computing system to:

send, to a wireless audio-output device, third audio data, wherein the third audio data includes a representation of the third audio data;

determine, using the device, fourth audio data corresponding to a second direction; and determine that a signal-to-interference ratio of the fourth audio data is less than a threshold.

19. The computing system of claim 13, wherein the at least one memory further includes instructions that, when executed by the at least one processor, further cause the computing system to:

receive, from the device, third audio data;

determine, using the device, fourth audio data corresponding to the first direction;

determine that a third average energy level of the third audio data is less than the first threshold;

determine that a fourth average energy level of the fourth audio data is greater than the first threshold; and associate the first direction with an audio-output device.

20. The computing system of claim 13, wherein the at least one memory further includes instructions that, when executed by the at least one processor, further cause the computing system to:

determine, by the device, the first product by multiplying a third sample of the first audio data by a fourth sample of the first audio data, the third sample occurring before the first sample and the fourth sample occurring after the first sample; and determine, by the device, the second product by multiplying a fifth sample of the second audio data by a sixth sample of the second audio data, the fifth sample occurring before the second sample and the sixth sample occurring after the second sample.

* * * * *